United States Patent [19]

Urschitz

[11] Patent Number: 4,747,730

[45] Date of Patent: May 31, 1988

[54] TRESTLE BEING DISPLACEABLE ON CATERPILLAR

[75] Inventor: Ernst Urschitz, Amstetten, Austria

[73] Assignee: Voest-Alpine Aktiengesellschaft, Linz, Austria

[21] Appl. No.: 1,466

[22] Filed: Jan. 8, 1987

[30] Foreign Application Priority Data

Jan. 22, 1986 [AT] Austria ..... 146/86

[51] Int. Cl.[4] ..... E21D 23/08

[52] U.S. Cl. ..... 405/298; 405/299

[58] Field of Search ..... 405/291, 293, 294, 298, 405/299; 299/31, 33

[56] References Cited

U.S. PATENT DOCUMENTS 4,010,618 3/1977 Walker et al. .
4,348,138 9/1982 Blampain et al. ..... 405/297
4,358,224 11/1982 Blanpain et al. ..... 405/298

FOREIGN PATENT DOCUMENTS 2530340 8/1976 Fed. Rep. of Germany .
2043743 10/1980 United Kingdom ..... 405/298

*Primary Examiner*—David H. Corbin

*Attorney, Agent, or Firm*—Cushman, Darby & Cushman

[57] ABSTRACT

The invention refers to a trestle (1) being displaceable on caterpillars (2) and having an approximately rectangular cross section and serving the purpose of supporting the roof in underground cavities, in particular serving the purpose of securing the excavating edge when recovering pillars (19) in coal mining, the trestle comprising a cap (4) being supported against a base frame (3) by hydraulically expandable props (5) extending approximately vertically relative to stratification. The trestle (1) has, related to the travelling direction of its floor chassis (2), at its both sides supporting plates being adjustable in outward direction and/or horizontal driveable caterpillar chassis being adjustable in outward direction. The supporting plates (22, 23) and/or the lateral caterpillar chassis (20, 21) are adjusted against the frame of the trestle by means of hydraulic or pneumatic pistons and cylinders and are adjustable in outward direction. Beside the cap (4), there can be arranged an optionally driveable caterpillar chassis (26) being adjustable in direction to the roof and extending in parallel relation to the floor chassis or the plurality of such chassis (2).

6 Claims, 4 Drawing Sheets

TRESTLE BEING DISPLACEABLE ON CATERPILLAR

BACKGROUND OF THE INVENTION

1. Field of the Invention

The invention refers to a trestle being movable on a floor chassis comprising driveable caterpillars and having an approximately rectangular horizontal projection and serving the purpose of supporting the roof in underground cavities, in particular serving the purpose of securing the excavating edge when recovering pillars in coal mining, said trestle comprising a roof cap being supported against a base frame by hydraulically expandable props extending approximately vertically relative to stratification.

2. Description of the Prior Art

Such trestles are, as a rule, used in upright position one beside the other and serve the purpose to support the roof if the coal pillars remaining during excavation work shall be excavated. In such a case, the trestles shall be supported one against the other, on the one hand, and against the coal pillars, on the other hand, and shall again be removed out of the excavated material, so that they can again be used.

SUMMARY OF THE INVENTION

It is an object of the invention to reliably support the trestles one against the other and against the coal pillars and to facilitate removal of the trestles from the excavated material. For this purpose, the invention essentially consists in that the trestle has, referred to the travelling direction of its floor chassis, at its both sides supporting plates and/or horizontal driveable caterpillar chassis being supported against the frame of the trestle and being adjustable in outward direction. On account of the adjustable supporting plates and on account of the lateral caterpillar chassis, respectively, the trestles can effectively be supported against the just adjacent trestles and against the coal pillars and can, after having recovered the pillars, be moved out of their operating position by means of their caterpillars running on the floor, noting that the lateral supporting plates are retracted and the cap is lowered, whereupon the roof is allowed to collapse. If there are arranged at the sides of the trestle horizontal driveable caterpillar chassis being adjustable in outward direction, removal of the trestles under load is facilitated because such removal is not only effected by the caterpillar chassis running on the floor but also by the laterally arranged caterpillar chassis. On account of the lateral supporting plates and the lateral caterpillar chassis being supported against the frame of the trestle, a statically defined arrangement becomes possible. With interposition of the frame of the trestle, the supporting plates and/or caterpillar chassis of the right-hand side can be supported against the supporting plates and/or the caterpillar chassis of the left-hand side, noting that supporting forces acting on one coal pillar can be transmitted to the other coal pillar via a series of trestles. If the cap is formed of a plate, lowering of the cap is sufficient for providing the possibility to remove the trestle from the excavated material. According to the invention, it is, however, also possible to arrange beside the cap an optionally driveable caterpillar chassis being adjustable against the roof and extending in parallel relation to the floor chassis or to the plurality of floor chassis. When removing the trestle out of the excavated material, this removal movement can then also be assisted by the caterpillar chassis coöperating with the roof. This is of advantage in particular in case of a fragile roof.

According to the invention, the supporting plates and/or caterpillar chassis are adjustable by means of hydraulic or pneumatic pistons and cylinders.

According to a preferred embodiment of the invention, the arrangement is such that supporting plates and caterpillar chassis are alternating one with the other in height direction. In this case, there exists the possibility to activate only the supporting plates or only the lateral caterpillar chassis. There exists also the possibility to remove the trestle out of the excavated material by means of the caterpillar chassis running on the floor and optionally the chassis running on the roof as well as by means of the several lateral chassis, noting that the supporting plates between the several lateral caterpillar chassis prevent premature rupture of the coal pillar which would detract from the action of the laterally arranged caterpillar chassis.

BRIEF DESCRIPTION OF THE DRAWING

In the drawing, the invention is schematically illustrated with reference to examples of embodiment.

FIG. 2 shows a side elevation in direction of the arrow II of FIG. 1.

FIG. 4 shows a side elevation in direction of the arrow IV of FIG. 3.

FIG. 6 shows a side elevation in direction of the arrow VI of FIG. 5.

DETAILED DESCRIPTION OF THE PREFERRED EMBODIMENTS

Figure 1:
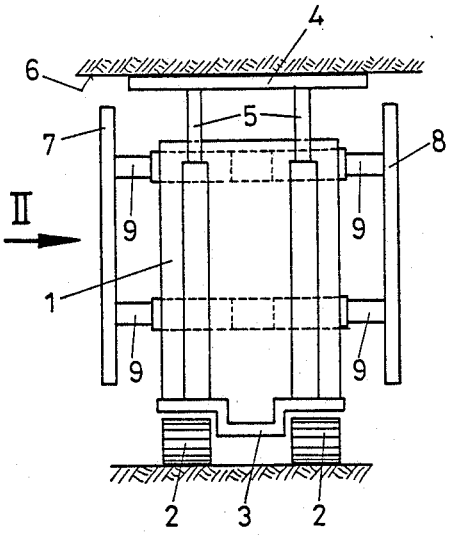
FIGS. 1 and 2 show a trestle comprising lateral supporting plates, noting that FIG. 1 shows a front elevation
Figure 2:
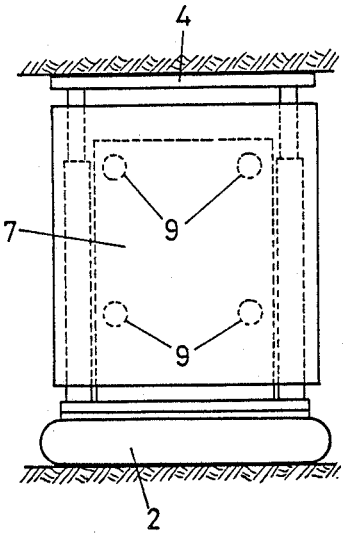

In the arrangement according to FIGS. 1 and 2, reference numeral 1 designates the frame of the trestle. The trestle can be displaced on the floor by means of the caterpillar chassis 2 running on the floor. An extensible roof cap 4 is supported by means of hydraulic props 5 against a base frame 3 being rigidly connected with the frame 1 and carrying the several caterpillar chassis 2 running on the floor, said roof cap being capable of being pressed against the roof 6 during operation. On both sides of the trestle there is arranged one respective supporting plate 7 and 8, respectively, extending over a major portion of both side surfaces. This both supporting plates 7 and 8 are supported one against the other via the interpositioned frame 1 and against this frame 1 by means of hydraulic props 9 which are held within the frame 1 of the trestle.

Figure 3:
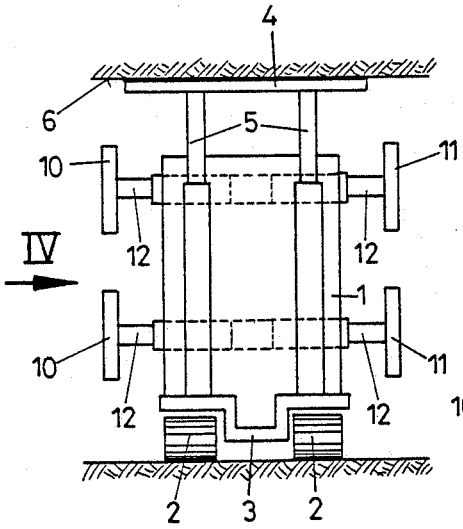
FIGS. 3 and 4 show a modified embodiment comprising a plurality of laterally arranged supporting plates, noting that FIG. 3 shows a front elevation
Figure 4:
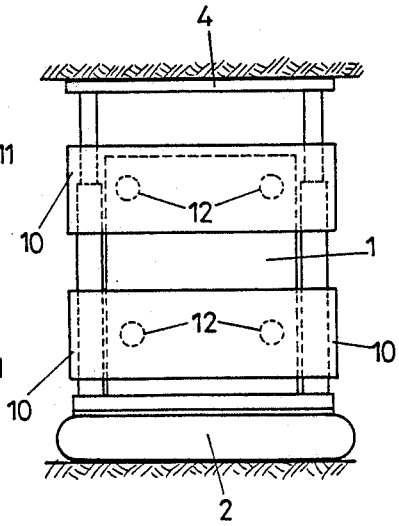

The embodiment according to FIGS. 3 and 4 differs from the embodiment according FIGS. 1 and 2 insofar as two supporting plates 10 and 11 are arranged one above the other at each side of the trestle. The supporting plates 10 and 11 are again supported by means of hydraulic props 12 against the frame 1 and via the interpositioned frame against the supporting plates 11 and 10. In this embodiment, the supporting forces of the lower supporting plates 10, 11 and the lower props 12, respectively, can be selected to be different from the supporting forces of the upper supporting plates 10, 11 and the upper props 12, respectively.

Figure 5:
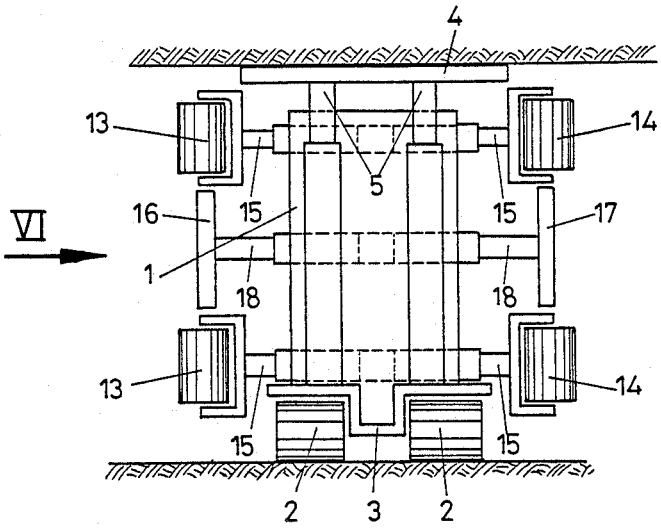
FIGS. 5 and 6 show a modified embodiment comprising laterally arranged supporting plates and caterpillar chassis, noting that FIG. 5 shows a front elevation
Figure 6:
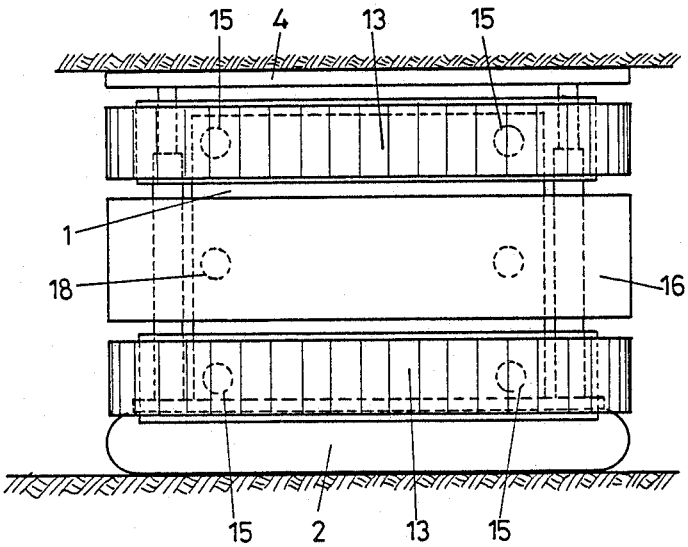

FIGS. 5 and 6 show an embodiment, in which are alternating in height direction supporting plates 16, 17 and laterally arranged driveable caterpillar chassis 13, 14. At each side of the trestle 1, there are arranged two caterpillar chassis 13 and 14, noting that these caterpillar chassis 13 are again supported against the caterpillar chassis 14 by hydraulic props 15 via the interpositioned frame 1. Between these both caterpillar chassis there is arranged one supporting plate 16 and 17, respectively, noting that the supporting plates 16 and 17 are again supported one against the other by means of props 18 via the interpositioned frame 1.

Figure 7:
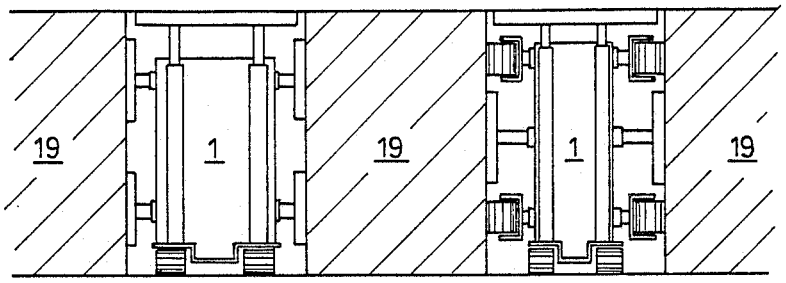
FIGS. 7, 8 and 9 show in a front elevation examples for using trestles according to FIGS. 3 and 4 as well as according to FIGS. 5 and 6.

FIG. 7 shows in a front elevation the use of individual trestles between coal pillars 19. A trestle according to FIGS. 3 and 4 is selected at the left-hand side, while a trestle according to FIGS. 5 and 6 is selected at the right-hand side.

Figure 8:
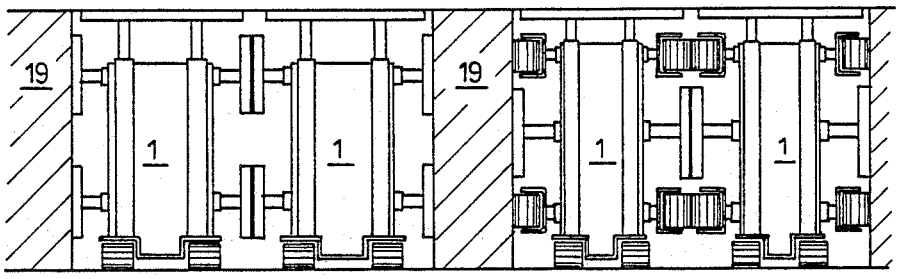

FIG. 8 shows in a front elevation the use of two trestles supported one against the other between coal pillars 19. Trestles according to FIGS. 3 and 4 are selected at the left-hand side, while trestles according to FIGS. 5 and 6 are selected at the right-hand side.

Figure 9:
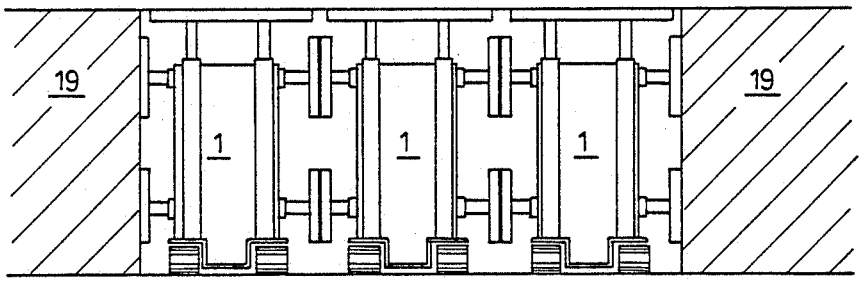

FIG. 9 shows the use of a group of three trestles 1 according to FIGS. 3 and 4 being supported one against the other. Such an arrangement is selected in those cases in which the coal pillars 19 are located at a greater distance one from the other.

Figure 10:
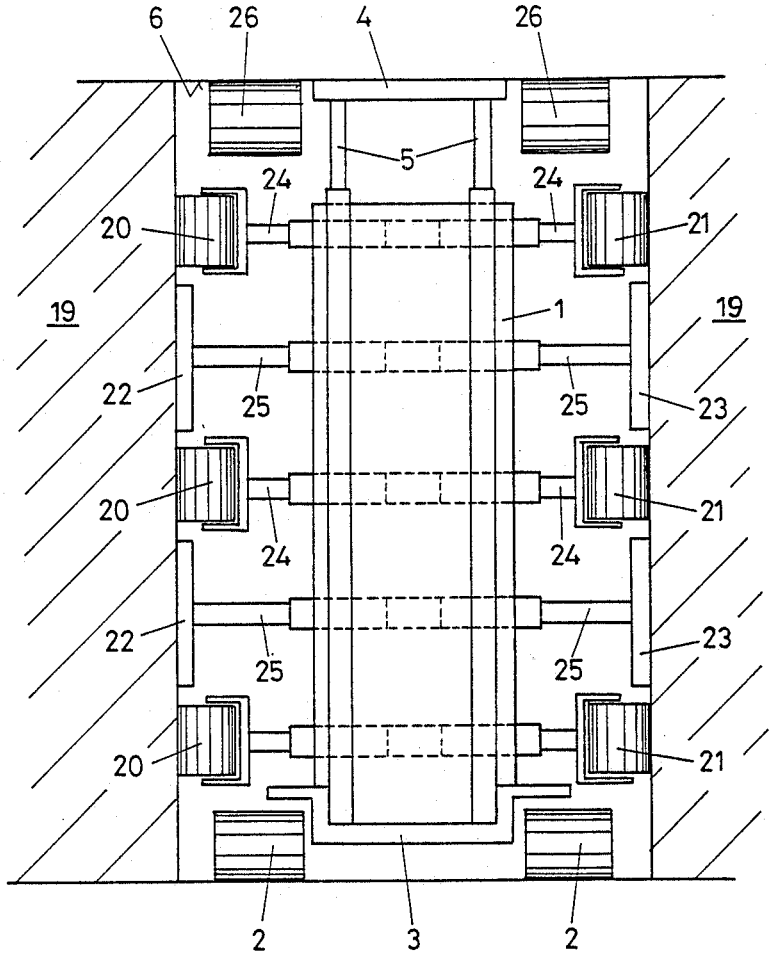
FIG. 10 shows in a front elevation a modified embodiment of a trestle located between two coal pillars.

FIG. 10 shows a modified embodiment of a trestle in a front elevation. In the trestle according to FIG. 10, there is arranged at both sides a plurality of caterpillar chassis 20, 21 with which alternate in height direction supporting plates 22 and 23. Between two caterpillar chassis 20 at the left-hand side, there is arranged a supporting plate 22, while a supporting plate 23 is arranged between two caterpillar chassis 21 at the right-hand side. Here again, the caterpillar chassis 20 are supported by hydraulic props 24 against the frame 1 and via this frame against the caterpillar chassis 21. The supporting plates 22 are supported by hydraulic props 25 against the frame 1 and via this frame against the supporting plates 23. Furthermore, a caterpillar chassis 26, being adjustable in direction to the roof 6, is arranged at each side of the cap 4. These caterpillar chassis 26 travelling on the roof can be supported against the base frame 3 and via this base frame against the floor chassis 2 by separate props, not shown, or the caterpillar chassis 26 travelling on the roof can be supported against the cap 4 and be adjustable together with this cap by the props 5.

What is claimed is:

1. A trestle being movable on a floor chassis comprising driveable caterpillars and having an approximately rectangular horizontal projection and serving the purpose of supporting the roof in underground cavities, in particular serving the purpose of securing the excavating edge when recovering pillars in coal mining, said trestle comprising a roof cap being supported against the base frame by hydraulically expandable props extending approximately vertically relative to stratification, characterized in that the trestle has, referred to the travelling direction of its floor chassis (2), at its both sides supporting plates (7, 8; 10, 11; 16, 17; 22, 23) and/or horizontal driveable caterpillar chassis (13, 14; 20, 21) being supported against the frame (1) of the trestle and being adjustable in outward direction.

2. Trestle as claimed in claim 1, characterized in that the supporting plates and/or the caterpillar chassis of the right-hand side are supported against the supporting plates (7, 8; 10, 11; 16, 17; 22 , 23) and/or the caterpillar chassis (13, 14; 20, 21) of the left-hand side with interposition of the frame (1).

3. Trestle as claimed in claim 1, characterized in that the supporting plates (7, 8; 10, 11; 16, 17; 22, 23) and or the lateral caterpillar chassis (13, 14; 20, 21) are adjustable by means of hydraulic or pneumatic pistons and cylinders.

4. Trestle as claimed in claim 1, characterized in that supporting plates (16, 17; 22, 23) and lateral caterpillar chassis (13, 14; 20, 21) are alternating one with the other in height direction.

5. Trestle as claimed in claim 1, characterized in that the roof cap is at least partially formed of a caterpillar chassis (26) being supported against the base frame (1) and being adjustable against the roof (6) and extending in parallel relation to the chassis or plurality of chassis (2) running on the floor and being optionally driveable.

6. Trestle as claimed in claim 1, characterized in that beside the roof cap formed of a supporting plate (4) there is arranged at least one driveable caterpillar chassis (26) running on the roof and being adjustable against the roof (6) and extending in parallel relation to the floor chassis (2) or the plurality of floor chassis.

* * * * *